US006287138B1

(12) United States Patent
Kuang

(10) Patent No.: US 6,287,138 B1
(45) Date of Patent: Sep. 11, 2001

(54) FIXING DEVICE FOR EXTENSION CARD OF COMPUTER

(75) Inventor: Yen Kuang, Taipei (TW)

(73) Assignee: Inventec Corporation, Taipei (TW)

( * ) Notice: Subject to any disclaimer, the term of this patent is extended or adjusted under 35 U.S.C. 154(b) by 0 days.

(21) Appl. No.: 09/631,673

(22) Filed: Aug. 3, 2000

(51) Int. Cl.[7] ..... H01R 13/62
(52) U.S. Cl. ..... 439/372; 361/759; 361/801
(58) Field of Search ..... 439/355, 372; 361/759, 801, 809, 825

(56) References Cited

U.S. PATENT DOCUMENTS 4,931,909 * 6/1990 Backes ..... 361/399
5,045,976 * 9/1991 Guilleminot ..... 361/417
5,373,416 * 12/1994 Tran ..... 361/674
5,757,618 * 5/1998 Lee ..... 361/686
5,812,377 * 9/1998 Golbach ..... 361/759
5,822,196 * 10/1998 Hastings et al. ..... 361/801
6,132,235 * 10/2000 Kitada ..... 439/372

* cited by examiner

*Primary Examiner*—Khiem Nguyen
*Assistant Examiner*—Thanh-Tam Le
(74) *Attorney, Agent, or Firm*—Birch, Stewart, Kolasch & Birch, LLP

(57) ABSTRACT

The present invention provides a device for fixing an extension card to a computer case. The device replaces the conventional screw-fastening manner, and is especially suitable for fixing the extension card located in a limited space where screw fastening is not available. The device includes a fixing element having one end pivotally mounted on the computer case and the other end formed with a resilient plate for fixing the extension card. A pressing portion and a latch are formed on the fixing element so as to latch the fixing element when the fixing element is being rotated to a fastening position. When the extension card is to be removed, the user can depress the pressing portion to move the latch away from the computer case, then rotate the fixing element to a release position.

9 Claims, 5 Drawing Sheets

FIXING DEVICE FOR EXTENSION CARD OF COMPUTER

BACKGROUND OF THE INVENTION

1. Field of Invention

The present invention relates to a device for fixing extension card of a computer, and more particularly relates to a fixing device for extension card in which no tool is needed for a manual operation. The device is applicable to where the extension card is in a limited space where screw fastening is not available.

2. Related Art

Computer extension cards can be interfaces of a computer and its peripheral devices, and can be devices to expand functions of the computer. As shown in FIG. 1, an extension card can be a display card, a network card, an interface card, and so on. In order to fastening the extension card 9, a slot is provided on the CPU board for receiving the card. And, a standardized sheetmetal fastening plate 91 is fastened on one side of the extension card 9. One end of the fastening plate 91 can be inserted into a predetermined position formed on the computer, while the other end can be fastened by a screw 98 to the case of the computer via a folded-up surface 910 and a cutout formed thereon. In some limited space, such as in a laptop computer 8 as shown in FIG. 1, the extension card 9 has to be mounted in parallel with the planar direction of the computer, so that the fastening plate 91 is attached to a mounting hole on a vertical side, such as the back plate, 81 of the computer. In this situation, it will be difficult to use screw 98 and tools in the position close and parallel to the vertical side 81, especially when there are some extruded components, such as connectors or sockets 87, formed nearby which prevent the screw and tool from moving into the position. Generally, fastening by screws or other attachments will cost more time when assembly. The screws or small attachments are easy to lost, hard to use, and inconvenient for the manufacturer or user to assemble or disassemble the extension card or a cover plate for the mounting hole of extension card.

SUMMARY OF THE INVENTION

In order to solve the aforesaid problem, the present invention provides a device for fixing extension card of a computer. The fixing device for extension card can be manually operated without using a tool, and the device is applicable to where the extension card is in a limited space where screw fastening is not available.

To achieve the aforesaid object, a device for fixing an extension card of computer according to the present invention mainly includes a fixing element having one end pivotally mounted on a case of computer and adjacent to a mounting plate of an extension card. The fixing element includes a resilient plate which is rotatably movable between a fastening position to press and fix the folded-up surface of the mounting plate, and a release position to release the pressing when the resilient plate is moved away from the folded-up surface. As a result, the user can manually rotate the fixing element to fix and to release the extension card or a cover plate to the mounting hole of the extension card.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
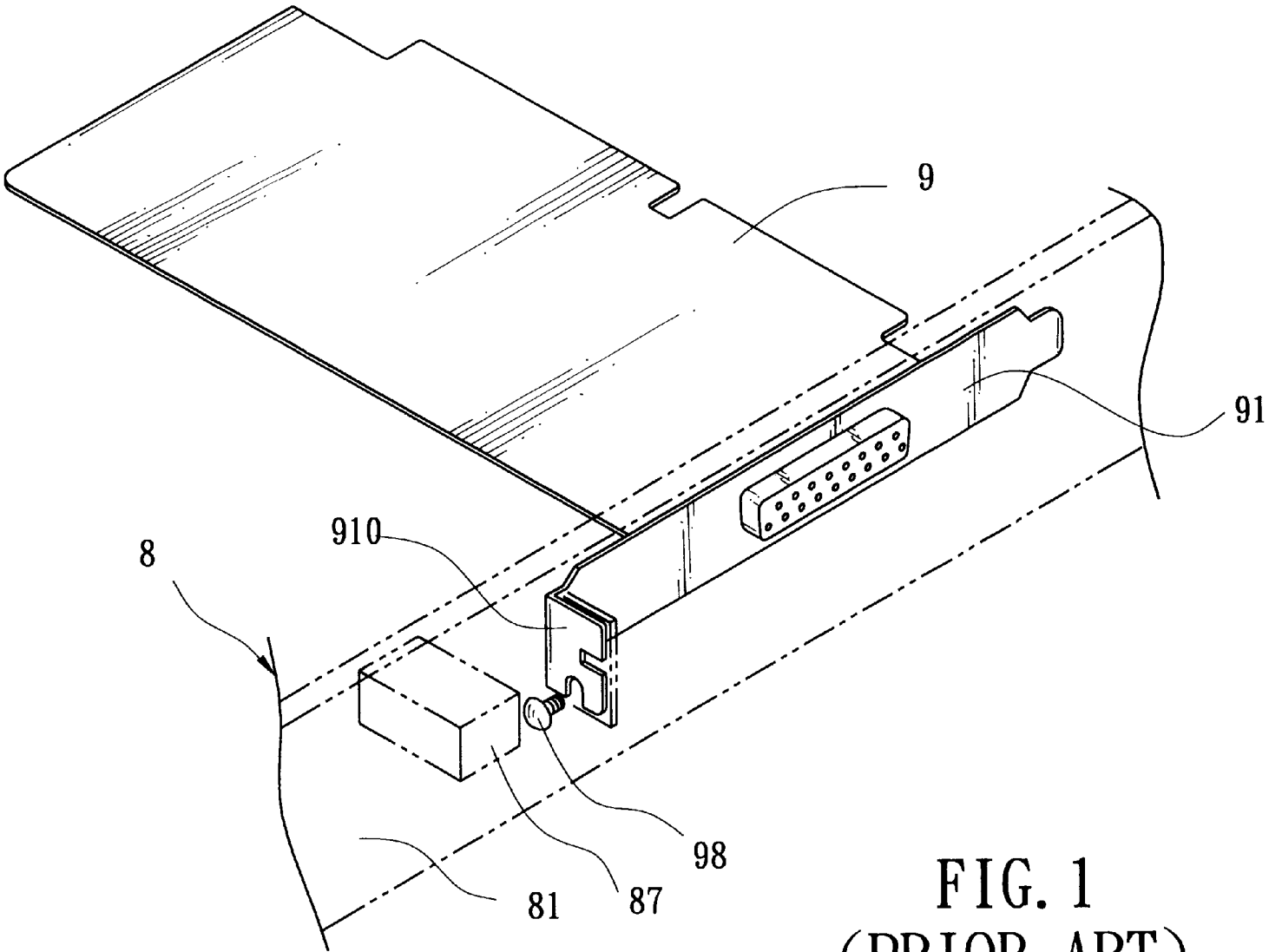
FIG. 1 (PRIOR ART)
FIG. 1 is a conventional fixing device of an extension card of computer.
Figure 2:
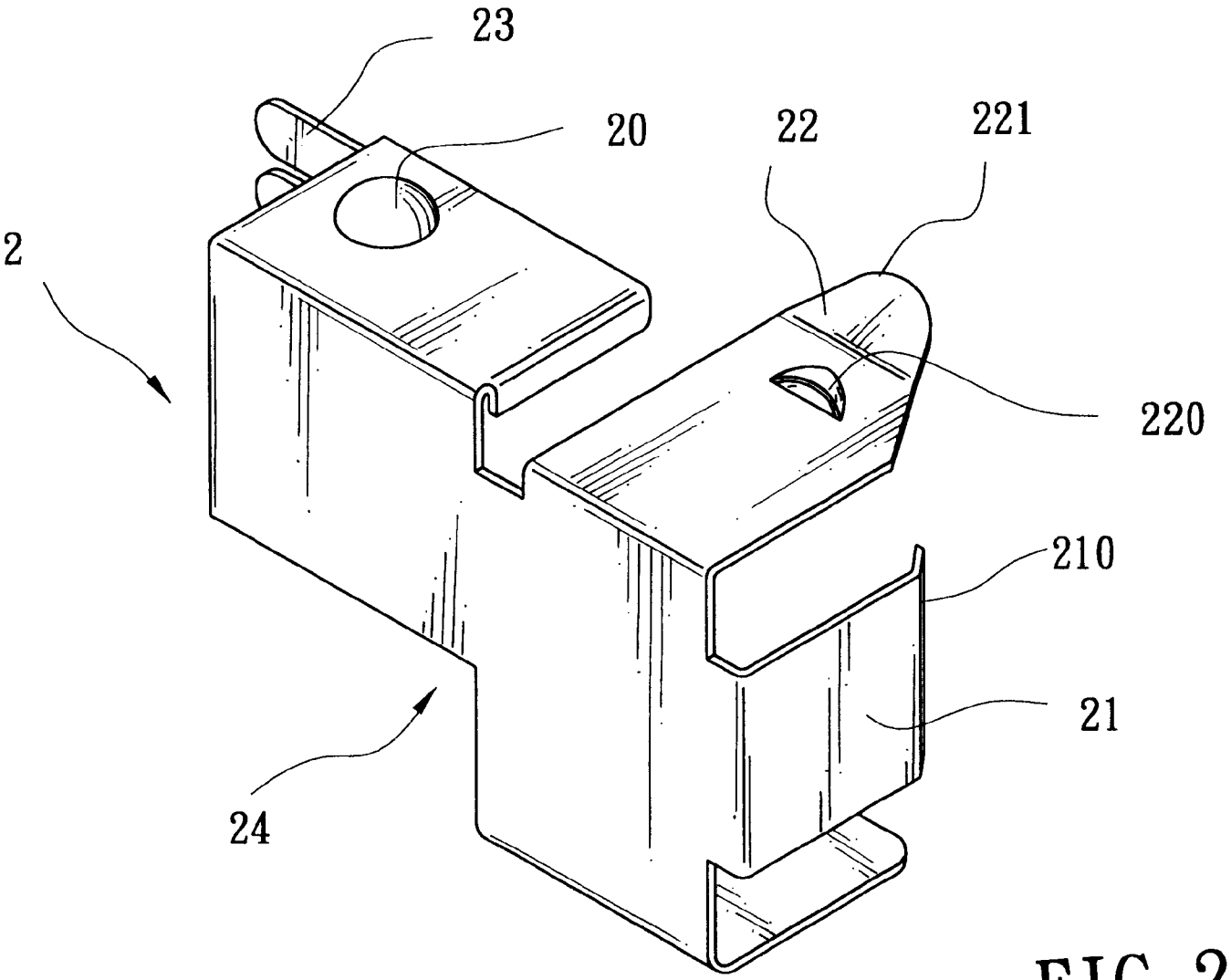
FIG. 2 is a perspective view of a fixing device of an extension card according to the present invention.

As shown in FIG. 2, a device for fixing an extension card of computer according to the present invention mainly includes a fixing element 2, made of metal (such as formed by sheetmetal), having one end formed with an upper and a lower pivotal portion 20 for being mounted on a corresponding pivotal portion 82 of a case 8 of a computer. The pivotal portions 20 or 82 can be semi-spherical extrusions, while the corresponding pivotal portions 82 or 20 are holes for receiving the semi-spherical extrusions. The fixing element 2 includes a resilient plate 21 formed at an opposite end to the pivotal portion 20 for fastening the mounting plate of an extension card 9 (see FIGS. 4A, 4B). A pressing portion 22 and a latch 220 are also formed on the fixing element 2 so as to latch the fixing element 2 by the latch 220 stopped at the border of the case 8 by the resilient force when the fixing element 2 is being rotated to the fastening position (see FIG. 4B). When the extension card 9 is to be removed, the user can depress the pressing portion 22 to move the latch 220 away from the border of the case 8, then rotate the fixing element 2 to a release position (see FIGS. 3A, 3B). A plurality of spring tips 23 are formed adjacent to the pivotal portion 20 for contacting the fixing element 2 to the case 8 when the fixing element 2 is at the fastening position where the fixing element 2 and the case 8 are electrically connected to achieve a function of preventing electromagnetic emission interference to and from any adjacent electronic components. A cutout 24, formed at a corner of the fixing element 2, as shown in the drawing, is to leave space for some other elements located on the case 8. If there is no other element, the cutout 24 can be removed. The operation of the fixing element 2 will be further described below.

Figure 3A:
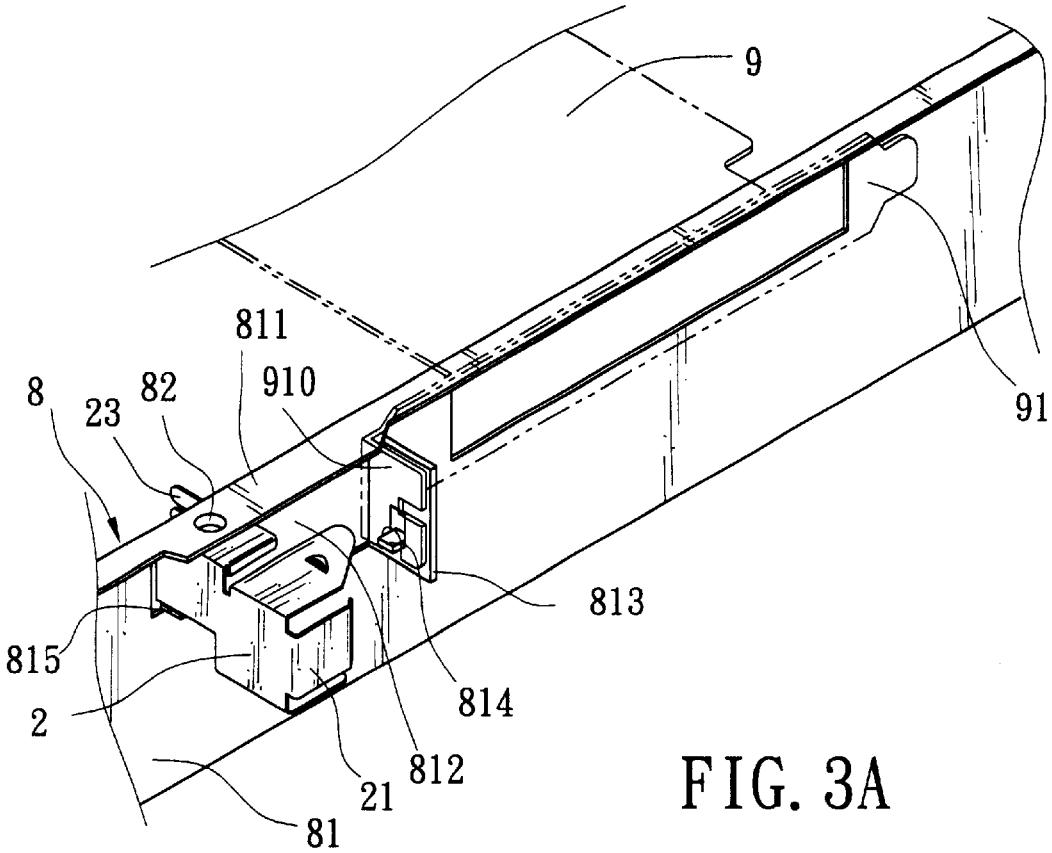
FIG. 3A is a descriptive drawing showing an embodiment of the present invention in which a fixing element is in a release position.
Figure 3B:
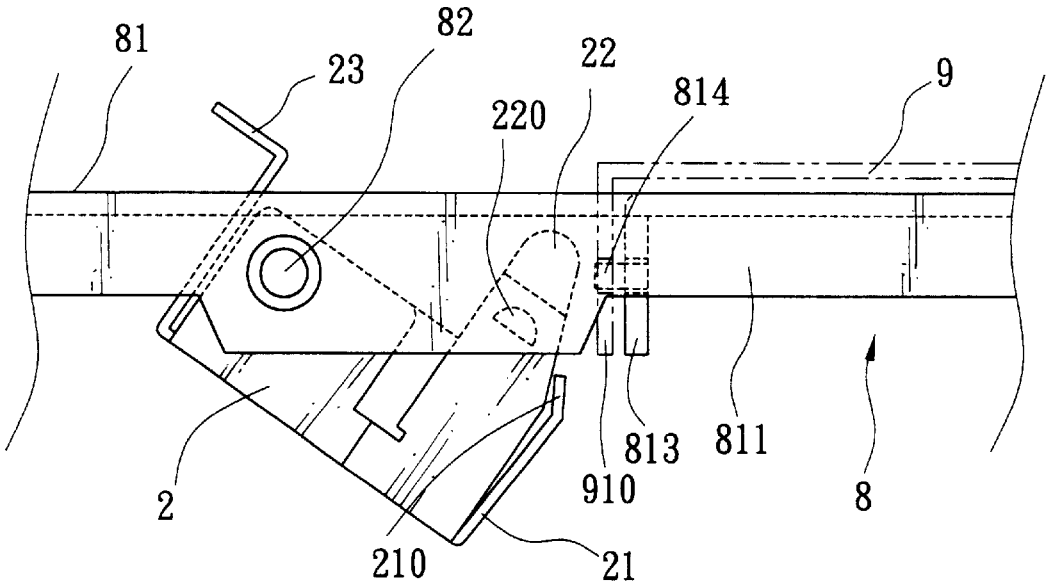
FIG. 3B is a descriptive drawing showing an embodiment of the present invention in which a fixing element is being pushed to a mounting plate of an extension card.
Figure 4A:
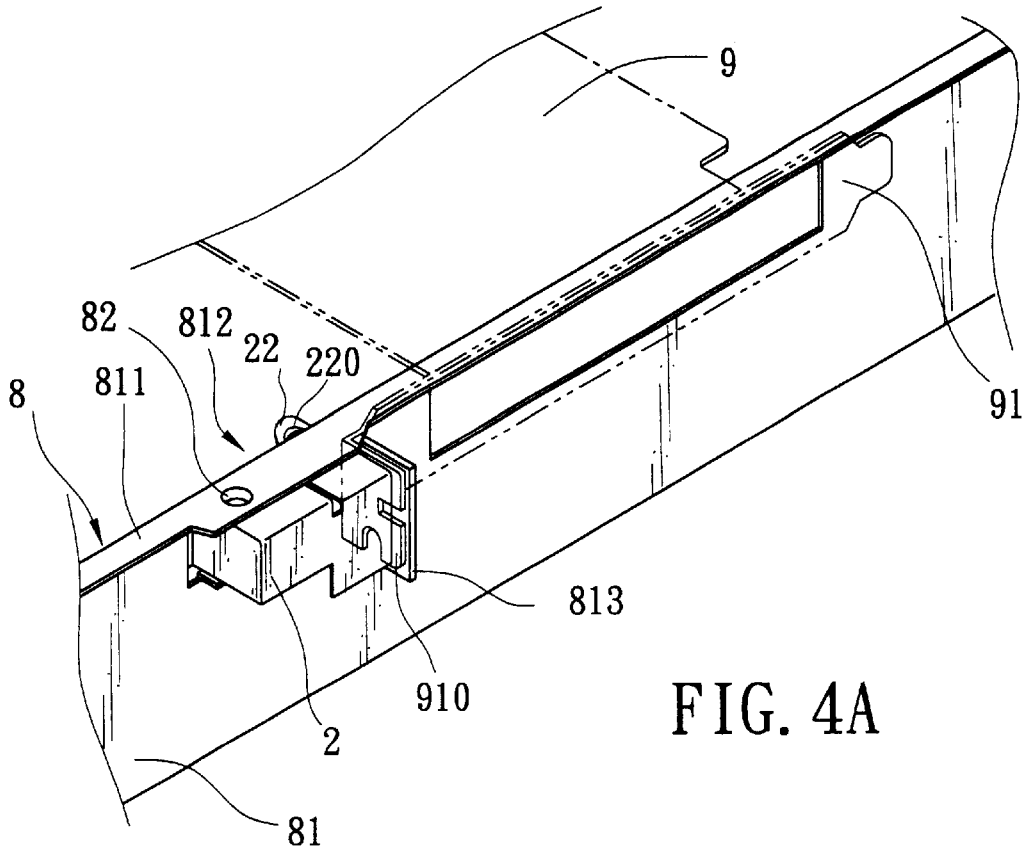
FIG. 4A is a descriptive drawing showing an embodiment of the present invention in which a fixing element is in a fastening position.
Figure 4B:
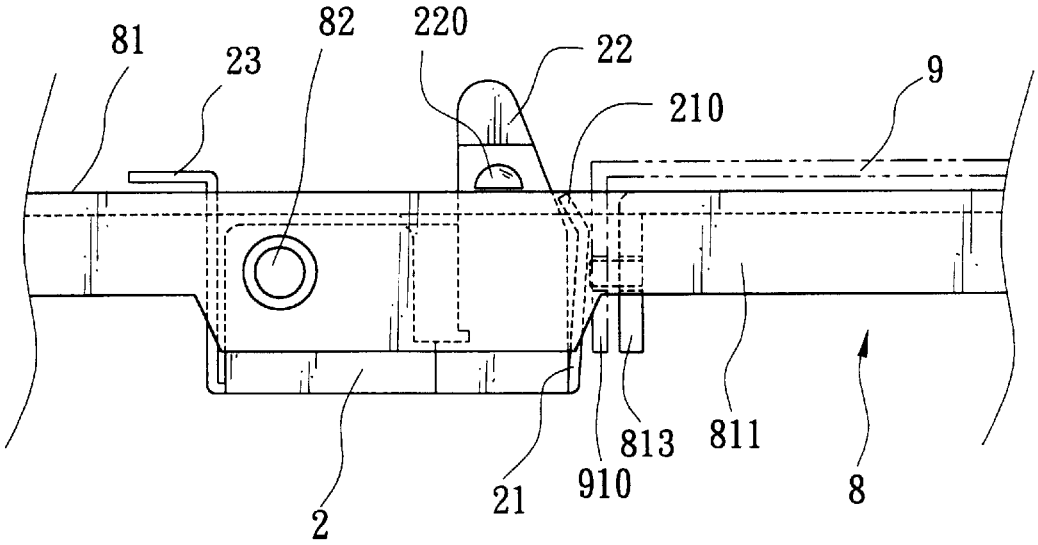
FIG. 4B is a top view of the condition of FIG. 4A.
Figure 5:
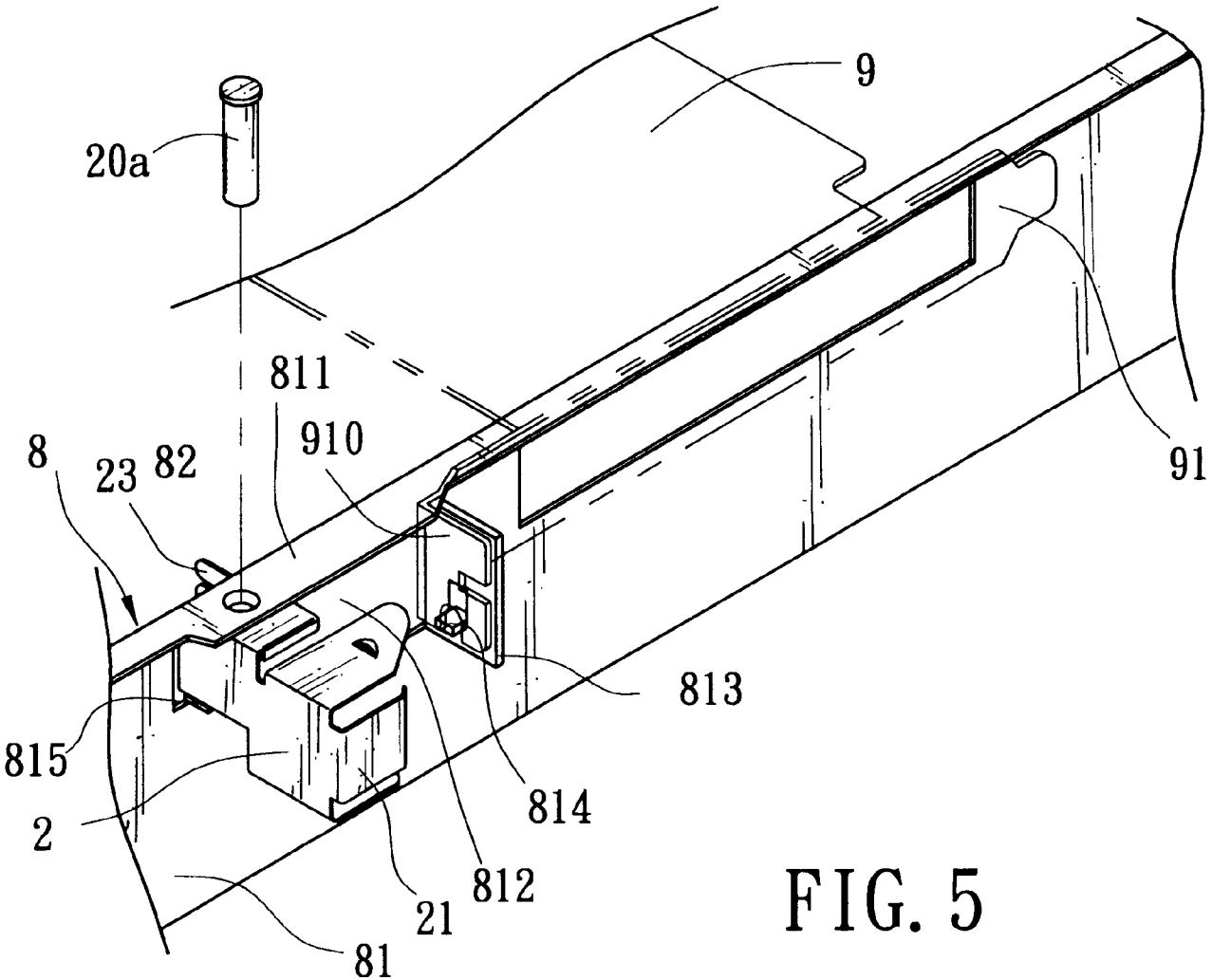
FIG. 5 is another embodiment of the present invention in which the fixing element is pivotally mounted on a computer case via a pivotal shaft.

FIG. 3B shows a usage condition of a fixing device according to the present invention where the fixing element 2 is in a release position. A horizontal surface 811 is formed perpendicularly to a vertical side 81 of a computer case 8. A substantially rectangular hole 812 for receiving the fixing element 2 is formed on the vertical side 81. A supporting surface 813 folded outwards from a rim of the hole 812 is used to support the folded-up surface 910 of the mounting plate 91 of extension card 9. An extrusion 814 is further formed on the supporting surface 813 to position the mounting plate 91 by a hole which is conventionally fastened by a screw to the case 8. A wing 815 is formed aside the hole 812 and parallel to the horizontal surface 811 for being formed with two opposite pivotal portions 82 to support the pivotal portions 20 of the fixing element 2. The pivotal portions 20 can be extrusions formed by press-forming on the sheetmetal fixing element 2; or, as shown in FIG. 5, a separated shaft 20*a* used to pass through the horizontal surface 811, the fixing element 2 and the wing 815 and to assemble the fixing element 2 on the case 8. The pivotal axis is parallel to the supporting surface 813 of the case 8 and the folded-up surface 910 of the extension card 9, so that when the fixing element 2 is rotated to make the resilient plate 21 press the folded-up surface 910 on the supporting surface 813, the extension card 9 is firmly fixed on the case 8, as shown in FIGS. 4A, 4B. Reversibly, the fixing element 2 can be rotated to release the extension card 9 from the case 8 as shown in FIGS. 3A, 3B.

FIGS. 4A or 4B shows a further usage condition of the fixing device of the present invention where the fixing element 2 is in the fastening position that the fixing element 2 is fully rotated into the hole 812 to make the resilient plate 21 press the folded-up surface 910 on the supporting surface 813. The latch 220 on the pressing portion 22 latches the rim of the horizontal surface 811 to prevent the fixing element 2 from getting loose. In order to provide suitable pressing forces and easy moving into positions for the resilient plate 21 and the pressing portion 22, the resilient plate 21 and the pressing portion 22 are formed first by being bent outwards and upwards respectively, then being bent at the tips inwards and downwards respectively.

On the assembly line, the fixing element 2 is mounted just by pressing the pivotal portions 20 into the corresponding pivotal portion 82 of the case 8. Then, after the extension card 9 or cover plate is being positioned, the fixing element 2 is rotated toward the case 8 to fix the extension card 9 or the cover plate. On the contrary, the user can press the pressing portion 22 to release the latch 220 then turn the fixing element 2 outwards for releasing the extension card 9.

In conclusion, the advantages of the present invention are at least:

a) no tool is needed for the user or the manufacturer to install or remove the extension card;

b) the fixing element is mounted on the computer case after assembly and prevented from loss; and c) no small items are to be picked up or handled.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for fixing an extension card of a computer to a computer case comprising:

a fixing element having one end pivotally mounted on the case and adjacent to a mounting plate of the extension card; and a resilient plate, formed on the fixing element, to be rotatably movable between a fastening position to press and fix a folded-up surface of the mounting plate, and a release position to release the pressing when the resilient plate is moved away from the folded-up surface, the computer case being formed with a rectangular hole for receiving the fixing element, and a supporting surface being folded outwards from a rim of the hole for supporting the folded-up surface of the mounting plate.

2. The device for fixing an extension card of computer as recited in claim 1 wherein the fixing element comprises a pivotal portion formed with a pair of semi-spherical extrusions to be fitted into corresponding pivotal holes formed on the computer case.

3. The device for fixing an extension card of computer as recited in claim 1 wherein the fixing element comprises a pivotal portion having a shaft passing through the computer case and the fixing element to pivot the fixing element on the computer case.

4. The device for fixing an extension card of computer as recited in claim 1 wherein the fixing element is formed with a pressing portion and a latch for latching the fixing element by the latch fixed at a border of the computer case by resilient force of the pressing portion when the fixing element is being rotated to the fastening position; and releasing the fixing element when the pressing portion is depressed by user to move the latch away from the border of the computer case and aloud the fixing element to be rotated to the release position.

5. The device for fixing an extension card of computer as recited in claim 1 wherein the fixing element is formed with a plurality of spring tips for contacting the fixing element to the computer case when the fixing element is at the fastening position where the fixing element and the computer case are electrically connected to achieve a function of preventing electromagnetic emission interference to and from any adjacent electronic components.

6. The device for fixing an extension card of computer as recited in claim 4 wherein the pressing portion of the fixing element is formed first by being bent outwards then being bent at the tips inwards so as to get a suitable pressing force and to be easily moved into position.

7. The device for fixing an extension card of computer as recited in claim 1 wherein the supporting surface is formed with an extrusion for positioning the folded-up surface of the mounting plate by a hole which is conventionally fastened by a screw to the computer case.

8. The device for fixing an extension card of computer as recited in claim 1 wherein the resilient plate is formed first by being bent outwards then being bent at the tips inwards so as to get a suitable pressing force to the folded-up surface of the mounting plate and to be easily moved into position.

9. The device for fixing an extension card of computer as recited in claim 1 is made of metal.

* * * * *